US006857891B1

(12) United States Patent
Morelli

(10) Patent No.: US 6,857,891 B1
(45) Date of Patent: Feb. 22, 2005

(54) HIGH FREQUENCY COAXIAL CONNECTOR

(75) Inventor: John Morelli, Palm Beach Gardens, FL (US)

(73) Assignee: SV Microwave, West Palm Beach, FL (US)

( * ) Notice: Subject to any disclaimer, the term of this patent is extended or adjusted under 35 U.S.C. 154(b) by 0 days.

(21) Appl. No.: 10/359,310

(22) Filed: Feb. 6, 2003

(51) Int. Cl.[7] ..... H01R 13/62
(52) U.S. Cl. ..... 439/319
(58) Field of Search ..... 439/319, 314–318

(56) References Cited

U.S. PATENT DOCUMENTS 3,665,371 A * 5/1972 Cripps ..... 439/319
3,711,815 A * 1/1973 Pierce et al. ..... 439/319
3,719,918 A * 3/1973 Kerr ..... 439/319
3,835,443 A * 9/1974 Arnold et al. ..... 439/319
4,068,911 A * 1/1978 Lodato et al. ..... 439/319
4,603,934 A * 8/1986 Burns ..... 439/319
4,746,305 A * 5/1988 Nomura ..... 439/319
5,474,466 A * 12/1995 Sakuraoka et al. ..... 439/319
5,683,263 A * 11/1997 Hsu ..... 439/319
6,203,349 B1 * 3/2001 Nakazawa ..... 439/319

* cited by examiner

*Primary Examiner*—Gary Pauman
(74) *Attorney, Agent, or Firm*—Levisohn, Berger & Langsam, LLP

(57) ABSTRACT

A coaxial connector suitable for high frequency applications is provided. The main body of the connector has an annular groove. A bayonet sleeve is provided at least partially slidably overlying the main body and having a recess groove at least partially corresponding to the annular groove in the main body. A biasing mechanism biases against the main body and the bayonet sleeve and is preferably disposed in the annular and recess grooves. The biasing mechanism exerts biasing force in a longitudinal direction of the connector to maintain the relative longitudinal position of the bayonet sleeve with respect to the main body. Because of the overlap of the bayonet sleeve and the main body acting in conjunction with the biasing mechanism, the bayonet sleeve is maintained in a stable, straight configuration, and signal loss or degradation is minimized.

19 Claims, 5 Drawing Sheets

HIGH FREQUENCY COAXIAL CONNECTOR

BACKGROUND OF THE INVENTION

1. Field of the Invention

The invention relates to connectors, and more specifically to "RF" coaxial connectors for high frequency systems.

2. Description of the Related Art

RF connectors are the forgotten component of microwave systems even though they have been in use for 100 years or so. Many design engineers consider them as an after thought, yet without a properly designed connector many of today's systems would not have been realized. nor would they have worked.

Initially, there were minimal performance parameters associated with these devices. During WWII, the emerging radar technology gave rise to the need for frequency-dependent performance parameters. During this time, Paul Neill, an engineer at Bell Labs, is credited with developing the first performance driven connector, the type "N". (The type N is a threaded air dielectric interface connector which is still used today.) Shortly after the development of the N connector, Karl Concelman, an engineer at IPC (the predecessor of Amphenol RF) is credited with the type "C" development. The C is a bayonet coupled connector with a Teflon dielectric interface. With these 2 connectors, many of the current commonly used connectors were derived. The BNC (Bayonet-Neill-Concelman) became the industry workhorse. The BNC connector today, besides its original 50 ohm configuration, has a 0.75 ohm version widely used in the telecommunications industry. The development of the TNC (a threaded BNC) is credited to General RF Fittings (GRFF), the predecessor of SV Microwave, the assignee of the instant invention.

A conventional BNC connector, as used in consumer electronics, communications systems, and widely in the broadcast industry, is shown in FIG. 1. The end of a coaxial cable is fitted into main body 1 and is connectable to a female receptacle (not shown) via bayonet sleeve 2. Contact 7 mates with a corresponding contact in the female receptacle, and outer conductor 3 mates with a corresponding outer conductor in the receptacle. A pin in the female receptacle engages the ramped circumferential groove in bayonet sleeve 2; when bayonet sleeve 2 is rotated, the female pin rides along the ramped groove, and the receptacle and the bayonet sleeve (and thus the BNC connector) are pulled together snugly. Spring washer 4 is fitted within the rear portion of bayonet sleeve 2 and has a concave shape. Spring washer 4 serves to provide some biasing force to bayonet sleeve 2.

The conventional BNC connector of FIG. 1 performs acceptably in traditional applications. However, in modem higher frequency applications, the conventional BNC connector is inadequate. The conventional BNC connector suffers from poor stability between the bayonet sleeve and the main body. The bayonet sleeve is loosely secured to the main body and has the ability to jiggle radially and can cant at an angle to the longitudinal axis of the connector. At lower frequencies, this loose fitting is acceptable because the signal is unaffected. However, as the frequency increases, the signal degrades; signal reflections may occur, clock signals may be ramped, or transmission of the signal may be lost entirely. Although the prior art BNC connector is rated by the manufacturer for signals of up to 4 GHz, it is not practically usable at frequencies above 2 GHz.

As mentioned above, another connector that is available is the TNC connector. In such a connector, the bayonet sleeve is replaced by a threaded coupling which facilitates the attachment to its mating receptacle. While the TNC connector is more secure and stable than the standard BNC connector, it is unwieldy to use. It is a relatively slow and time consuming process to manipulate the threads on the coupling sleeve. This is especially problematic in most modem telecommunications or broadcast applications, in which a person may have to secure tens or hundreds of connections at a time.

Thus, there is a long-felt need for an RF connector that is suitably stable for high frequency applications, e.g., in the range above 2 GHz, that is easy, secure, and quick to connect or disconnect.

SUMMARY OF THE INVENTION

It is an object of the invention to provide an RF connector that is suitably stable for high frequency applications.

It is another object of the invention to provide an RF connector that is suitably stable for high frequency applications that has a secure and quick connect/disconnect mechanism.

It is yet another object of the invention to provide a high frequency RF connector that is compatible with conventional BNC female receptacles.

The above and other objects are fulfilled by the invention, which is a coaxial connector, preferably in the form of a BNC connector. The inventive coaxial connector includes a main body for receiving an end of a coaxial cable or other transmission media and having an annular groove. A bayonet sleeve is provided at least partially slidably overlying the main body; the bayonet sleeve has a recess groove at least partially corresponding to the annular groove in the main body. A biasing mechanism, preferably disposed within the annular and recess grooves, exerts biasing force in a longitudinal direction of the connector to maintain the relative longitudinal position of the bayonet sleeve with respect to the main body.

The biasing means preferably includes a substantially C-shaped ring having two ends offset apart. In the preferred BNC embodiment, the offset is in the range of 0.010–0.015 inches or 10–15 mils. The offset is intended to allow the bayonet sleeve to travel up to 0.015 inches with respect to the main body when the appropriate force is applied by the user. One of the ends of the ring abuts a front wall of the annular groove and the recess groove and the other of the ends of the ring abuts a rear wall of the annular groove and the recess groove. In an alternate embodiment, the biasing mechanism is a coil spring disposed in the annular and recess grooves.

The bayonet sleeve overlies the main body to such an extent that angling of the bayonet sleeve with respect to the main body is substantially prevented. That is, the bayonet sleeve cannot be angled substantially with respect to the main body owing to the bayonet sleeve overlying the main body. Because of the overlap of the bayonet sleeve and the main body acting in conjunction with the biasing mechanism, the bayonet sleeve is maintained in a stable, straight configuration, and signal loss or degradation is minimized, even in high frequency applications in the range of above 2 GHz.

DETAILED DESCRIPTION OF THE PREFERRED EMBODIMENTS AND DRAWINGS

Description of the invention will now be given with reference to the attached FIGS. 2–4. It should be noted that these drawings are exemplary in nature and in no way serve to limit the scope of the invention, which is defined by the claims appearing hereinbelow.

Figure 1:
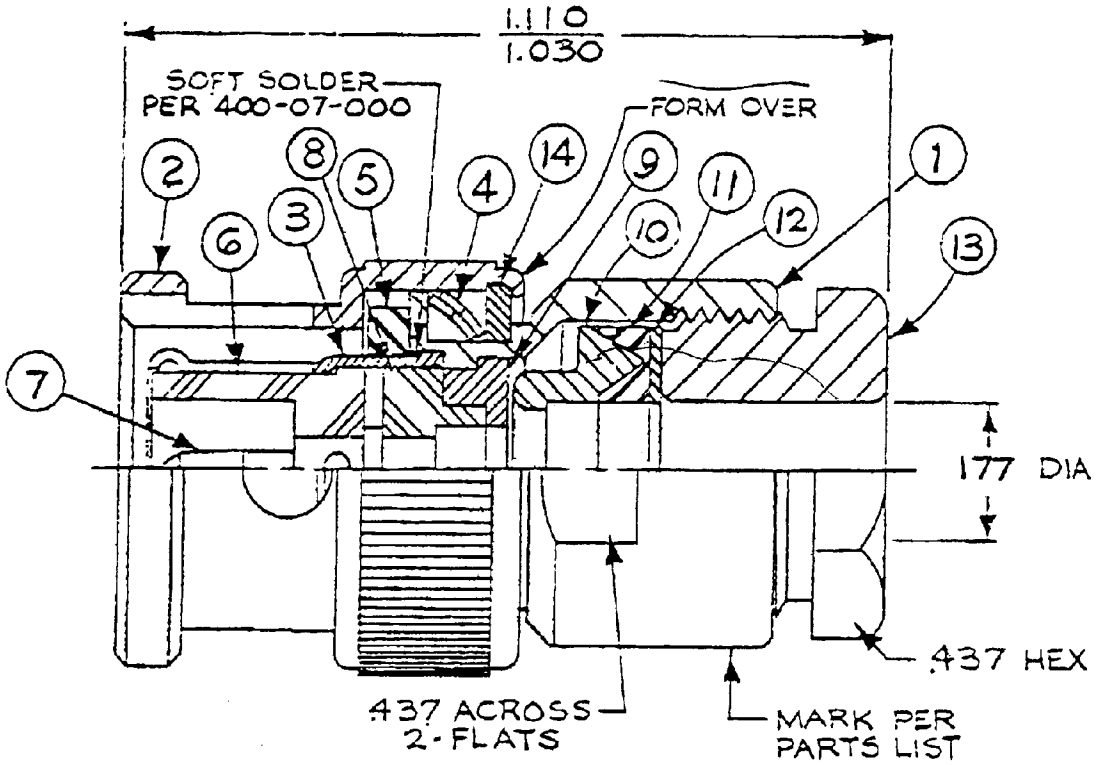
FIG. 1 PRIOR ART
FIG. 1 is a broken side sectional view of a conventional BNC-type coaxial connector.
Figure 2:
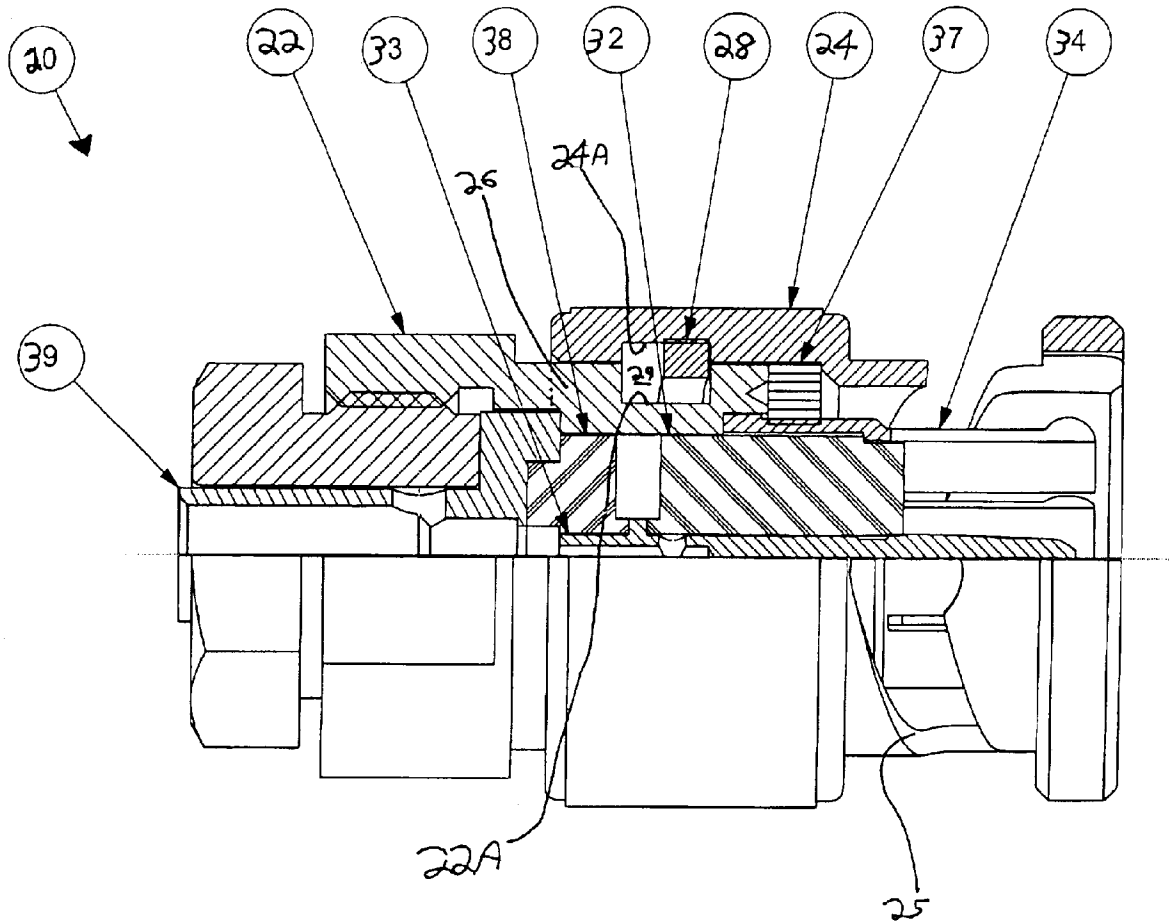
FIG. 2 is a broken side sectional view of a coaxial connector in accordance with the invention.
Figure 3:
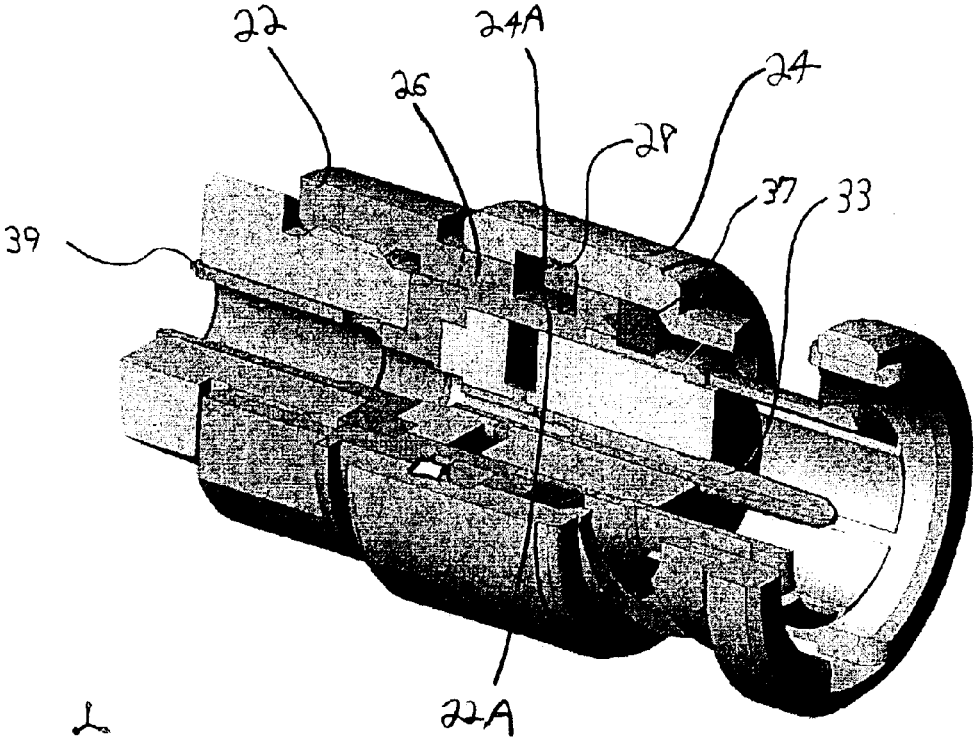
FIG. 3 is a broken isometric view of the coaxial connector of FIG. 2.

The preferred embodiment of the inventive connector is shown in partial section in FIGS. 2 and 3 as connector 20. A main body 22 is provided, for example, to receive the end of a coaxial cable or other transmission media, and a bayonet sleeve 24 is disposed at least partially overlying the main body 22. Bayonet sleeve 24 overlies rear section 26 of main body 22 to such an extent that the bayonet sleeve cannot be cocked or angled to any significant degree with respect to main body 22. In the preferred embodiment, rear section 26 is at least 25% of the overall length of the bayonet sleeve, more preferably at least 33%.

An outer annular groove 22A is formed on main body 22 in rear section 26, and an inner (annular) recess groove 24A is formed on bayonet sleeve 24 in a position corresponding to annular groove 22A. Each groove 22A and 24A has a front wall and a rear wall, and together the two grooves form an enclosed annular channel 29. A biasing mechanism is disposed in annular channel 29 and biases against the front and rear walls of annular channel 29. By providing longitudinal biasing force in this manner, the relative position of bayonet sleeve 24 with respect to main body 22 is kept substantially fixed, depending on the strength of the biasing mechanism.

Figure 4A:
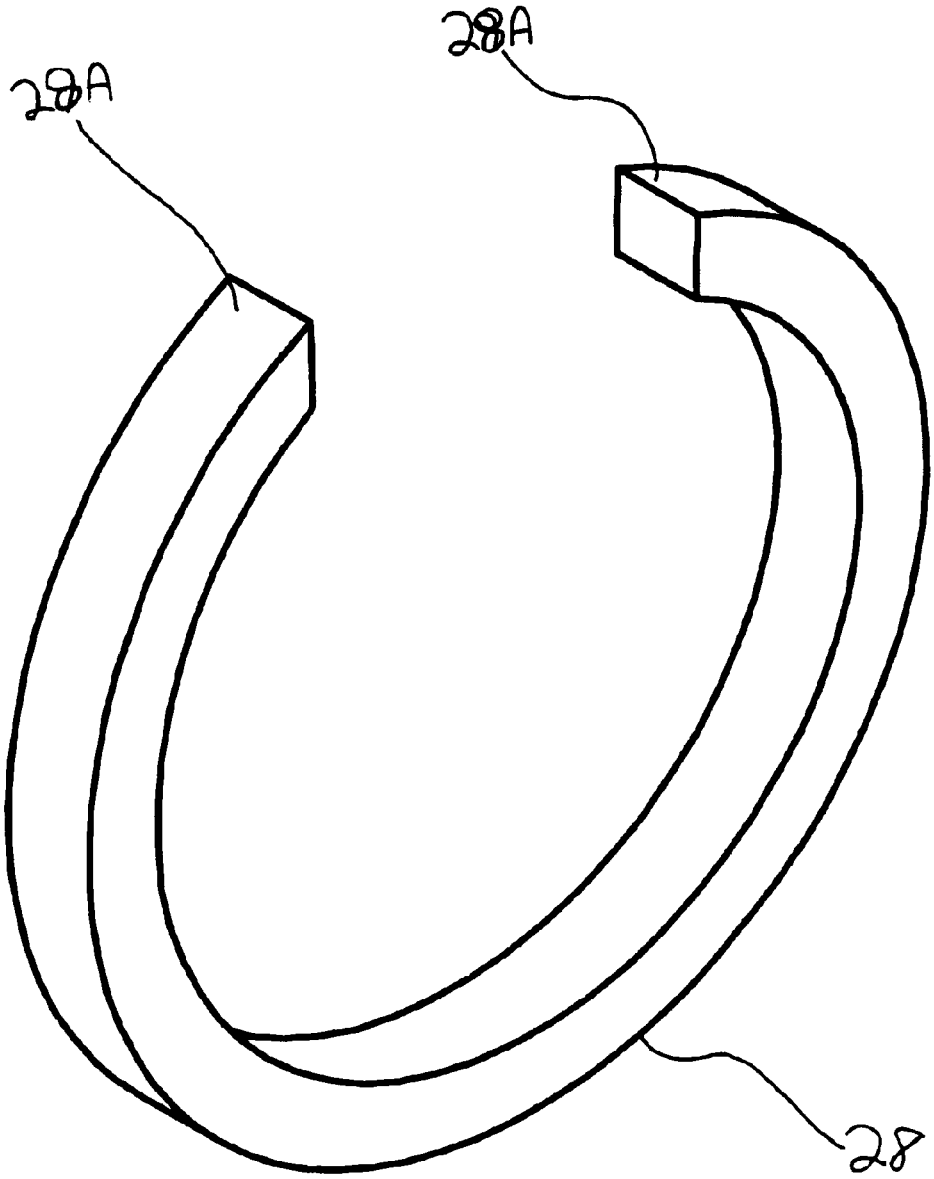
FIG. 4A is a perspective view of a preferred biasing mechanism in accordance with the invention.
Figure 4C:
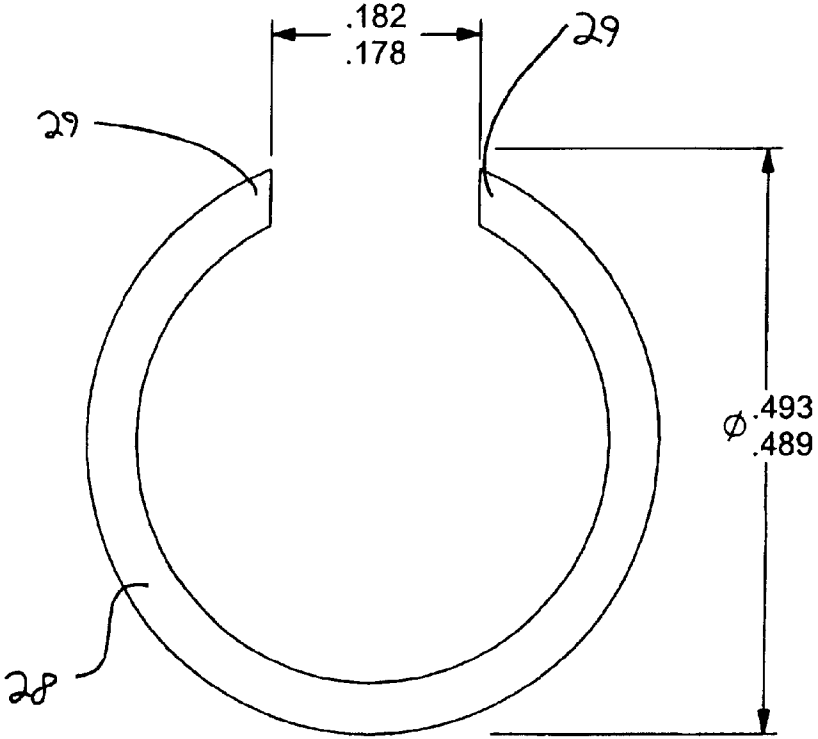
FIG. 4C is a top elevation of the biasing mechanism of FIG. 4A.
Figure 4B:
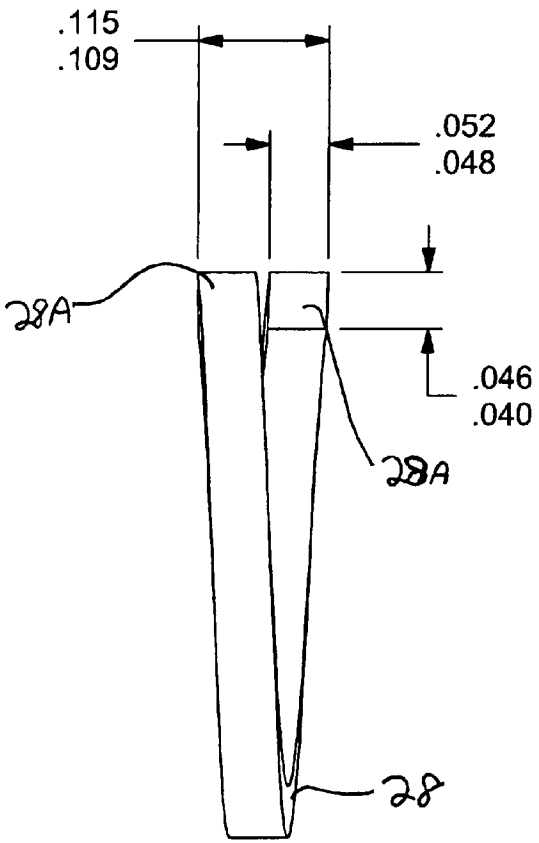
FIG. 4B is a side elevation of the biasing mechanism of FIG. 4A.

In the preferred embodiment, the biasing mechanism is realized by C-ring 28. As best shown in FIGS. 4A–C, C-ring 28 is, as its name implies, a ring with a portion cut out of it to form the shape of the letter C. The ends 28A are offset by a small amount so that C-ring 28 can provide biasing/retention force. One end 28A abuts the front wall of annular channel 29 and the other end abuts the rear wall of annular channel 29. It is preferable that the ends 28A engage at least a portion of both the walls of grooves 22A and 24A so that main body 22 and bayonet sleeve 24 are retained in a relative fixed configuration. C-ring 28 is preferably made from heat-treated beryllium copper.

Bayonet sleeve 24 should be allowed to move slightly in the longitudinal direction when force is applied; in the example given, it is preferred to be allowed to travel 0.015 inches. FIGS. 4B–C depict exemplary dimensions for C-ring 28. The offset of the two ends 28A—that is, the gap between the bottom edge of one end and the top edge of the other—is shown in FIG. 4B to be between 0.011 and 0.013 inches. The annular grooves arc narrower than C-ring 28 at its fully expanded offset to thereby produce biasing force (i.e., the force of the C-ring attempting to expand to its natural state). In this configuration, the bayonet sleeve is only permitted to travel 0.015 inches.

As an alternative, instead of C-ring 28, the invention might also utilize a coil spring disposed in annular channel 29.

The remaining elements of the inventive connector 20 serve their conventional roles. For example, connector 20 includes a central contact 33 and an outer contact 34, separated by an insulator 32. Another insulator 38 serves to isolate main body 22 from central contact 33. Ferrule 39 is provided to enable or facilitate the attachment of coaxial cable. Gasket 37 acts as a moisture seal. Bayonet sleeve 24 includes ramped groove 25 for engaging a pin in the female receptacle as in the conventional BNC connector.

Having described the invention in terms of the preferred embodiments, it should be understood that the scope of the invention is not limited by the above description or the drawings but rather is defined by the claims appearing hereinbelow. Modifications that would be apparent to one of ordinary skill in the art are deemed to be part of the invention so claimed. For example, the ends of the C-ring need not be offset by such a degree that they do not face each other; some overlap in the respective end faces is considered acceptable, depending upon the dimensions in question. Also, the above description mentions heat-treated beryllium copper as a preferred material for the C-ring. However, any material of sufficient elasticity may be used to create a biasing force, including but not limited to phosphor bronze, certain composite plastics, and the like.

It should also be understood that the invention is not limited solely to the cable connectors described above. The invention is also readily applicable for use in and with microwave transmission lines, RF circuits, resistor networks, and the like.

What is claimed is:

1. A coaxial connector, comprising:

a main body having an annular groove;

a bayonet sleeve at least partially slidably overlying said main body, said bayonet sleeve having a recess groove at least partially corresponding to said annular groove in said main body; and biasing means for biasing against said main body and said bayonet sleeve, wherein said biasing means exerts biasing force in a longitudinal direction of said connector to maintain the relative longitudinal position of said bayonet sleeve with respect to said main body.

2. A coaxial connector according to claim 1, wherein said biasing means is disposed between said main body and said bayonet sleeve.

3. A coaxial connector according to claim 2, wherein said biasing means is disposed within said annular groove and said recess groove.

4. A coaxial connector according to claim 1, wherein said biasing means comprises a substantially C-shaped ring having two ends offset apart.

5. A coaxial connector according to claim 3, wherein said biasing means comprises a substantially C-shaped ring having two ends offset apart, wherein one of said ends of said ring abuts a front wall of said annular groove and said recess groove and the other of said ends of said ring abuts a rear wall of said annular groove and said recess groove.

6. A coaxial connector according to claim 4, wherein said ring is substantially made from heat treated beryllium copper.

7. A coaxial connector according to claim 1, wherein said bayonet sleeve overlies said main body to such an extent that angling of said bayonet sleeve with respect to said main body is substantially prevented.

8. A coaxial connector according to claim 1, wherein said bayonet sleeve cannot be substantially angled with respect to said main body owing to said bayonet sleeve overlying said main body.

9. A coaxial connector according to claim 1, wherein said connector is a BNC connector.

10. A coaxial connector according to claim 1, wherein said biasing means comprises a coil spring disposed in said annular and recess grooves.

11. A coaxial connector according to claim 4, wherein the offset of said ends of said C-shaped ring is in the range of 0.010–0.015 inches.

12. A BNC connector, comprising:

a main body having an annular groove;

a bayonet sleeve slidably overlying said main body, said bayonet sleeve having a recess groove at least partially corresponding to said annular groove in said main body; and biasing means for biasing against said main body and said bayonet sleeve, wherein said biasing means exerts biasing force in a longitudinal direction of said connector to maintain the relative longitudinal position of said bayonet sleeve with respect to said main body.

13. A BNC connector according to claim 12, wherein said biasing means is disposed between said main body and said bayonet sleeve within said annular groove and said recess groove.

14. A BNC connector according to claim 12, wherein said biasing means comprises a substantially C-shaped ring having two ends offset apart, wherein one of said ends of said ring abuts a front wall of said annular groove and said recess groove and the other of said ends of said ring abuts a rear wall of said annular groove and said recess groove.

15. A BNC connector according to claim 14, wherein said C-shaped ring is substantially made from heat treated beryllium copper.

16. A BNC connector according to claim 14, wherein the offset of said ends of said C-shaped ring is in the range of 0.010–0.015 inches.

17. A BNC connector according to claim 12, wherein said bayonet sleeve overlies said main body to such an extent that angling of said bayonet sleeve with respect to said main body is substantially prevented.

18. A BNC connector according to claim 12, wherein said biasing means comprises a coil spring disposed in said annular and recess grooves.

19. A BNC connector according to claim 12, wherein said main body is adapted to receive the end of a coaxial cable.

* * * * *